US006046651A

United States Patent [19]

Wendel

[11] Patent Number: 6,046,651

[45] Date of Patent: Apr. 4, 2000

[54] MICROWAVE COMPONENT

[75] Inventor: Ralf Wendel, Pinneberg, Germany

[73] Assignee: U.S. Philips Corporation, New York, N.Y.

[21] Appl. No.: 09/129,860

[22] Filed: Aug. 6, 1998

[30] Foreign Application Priority Data

Aug. 7, 1997 [DE] Germany ..... 197 34 097

[51] Int. Cl.[7] ..... H01P 1/387

[52] U.S. Cl. ..... 333/1.1; 333/24.2; 174/35 MS

[58] Field of Search ..... 333/1.1, 24.1, 333/24.2; 174/35 R, 35 MS, 52.6

[56] References Cited

U.S. PATENT DOCUMENTS 3,355,680 11/1967 Saltzman et al. ..... 333/1.1
3,739,302 6/1973 McManus ..... 333/1.1

FOREIGN PATENT DOCUMENTS 1963684 9/1996 Germany .

OTHER PUBLICATIONS

PHD 96, 137, U.S. Serial No. 08/924,940, Filed: Sep. 8, 1997.

*Primary Examiner*—Paul Gensler
*Attorney, Agent, or Firm*—F. Brice Faller

[57] ABSTRACT

A microwave component is described with a substantially tub-shaped housing part which comprises a bottom portion and at least one wall portion merging into the circumference of the bottom portion, and with a lid part, said housing part and lid part being formed from a magnetically permeable material and enclosing an inner space in which a number of substantially disc-shaped components are provided in a stacked arrangement between the bottom portion and the lid part such that a partial space of the inner space adjoining at least a sub-portion of the bottom portion is left open by the stacked arrangement.

A compact construction benefiting miniaturization is obtained in this microwave component in spite of the accommodation of a bulky load impedance.

8 Claims, 10 Drawing Sheets

MICROWAVE COMPONENT

BACKGROUND OF THE INVENTION

The invention relates to a microwave component.

German patent application 196 36 840.5 describes a microwave component which comprises a substantially tub-shaped housing part with a bottom portion and at least one wall portion merging into the circumference of the bottom portion, and a lid part, the housing part and lid part surrounding an inner space. A number of substantially disc-shaped components are arranged in a stack in this inner space between the bottom portion and the lid part. Adjoining the stacked arrangement of the components, at least one magnetically non-permeable spacer element is provided between the bottom portion and the lid part adjoining the stacked arrangement of the components over at least substantially the entire height of the inner space. This spacer element is provided for filling up an intermediate space between the stacked arrangement of the components and the wall portion(s) with matching shape along at least part of that dimension of the wall portion(s) which extends at least substantially in the direction of the circumference of the bottom portion. The magnetically non-permeable spacer element may in this case be made from an electrically non-conducting material and not only serves as a mechanical retaining, device but also as an electrical insulation. The spacer element may in particular have a high dielectric constant. It is thus possible for at least a substantial portion of the intermediate space between the stacked arrangement of the components and the wall portion(s) to be filled up with a (material having a) high dielectric constant. In the cited patent application, it is further indicated that this space may be advantageously utilized for compact electrical or electronic circuit elements.

The present-day development of generic microwave components leads to a desire for ever more compact constructions with ever smaller dimensions, for various reasons. Among these reasons are on the one hand the continuing miniaturization of appliances in which such microwave components are used, and on the other hand also the operation of these microwave components at ever higher operating frequencies. This also relates to microwave circulators and microwave isolators which are usually constructed as microwave circulators with a built-in load impedance. In the usual construction thereof, the load impedance is arranged at the same level as a microwave guiding arrangement, such as used in a manner known per se in microwave circulators. This arrangement of the load impedance, however, has the disadvantage that a very large space must be provided for the load impedance at the level of the microwave guiding arrangement, especially if it is dimensioned for a high electric power dissipation. This means that a base surface of the bottom portion of the housing part of the microwave component extending in the direction of the plane of the microwave guiding arrangement must also have very large dimensions if the load impedance is to be enclosed by the housing part. This, indeed, is desirable for reasons of circuit and manufacturing technology.

The invention has for its object to improve a microwave component of the kind described above such that a compact construction which promotes miniaturization is obtained in spite of the inclusion of a larger load impedance.

SUMMARY OF THE INVENTION

According to the invention, this object is achieved by a microwave component with a substantially tub-shaped housing part which comprises a bottom portion and at least one wall portion which merges into the circumference of the bottom portion, and with a lid part. The housing part and lid part are made from a magnetically permeable material and enclose an inner space in which a number of substantially disc-shaped components are arranged in a stack between the bottom portion and the lid part such that a partial space of the inner space adjoining at least a sub-portion of the bottom portion is left open by the stacked arrangement.

The disc-shaped components, in particular a microwave guiding arrangement in the microwave component described in DE 196 16 840, are introduced into the substantially tub-shaped housing part adjacent the bottom portion thereof during assembly. As a result, a very small space is available for additional components, for example for a load impedance, adjoining the bottom portion, at any rate in the region of the non-permeable, non-conducting spacer element there. This available space, however, is not sufficient for the desired load impedances. An increase in this available space along the dimension of the bottom portion would inevitably lead to an enlargement of this portion.

In the microwave component according to the invention, by contrast, the substantially disc-shaped components in their stacked arrangement are so dimensioned and positioned that a suitable spatial region of the inner space of the tub-shaped housing part remains open, for example for accommodating a load impedance, adjoining at least one sub-portion, i.e. one partial surface region, of the bottom portion. This space referred to as partial space can thus be gained in particular without an enlargement of the bottom portion area of the housing part in that the sequence of stacking of the substantially flat components is so chosen that those components having the smallest dimensions, seen parallel to the bottom portion surface, are arranged so as to adjoin this bottom portion. The components having larger dimensions parallel to the bottom portion surface of the tub-shaped housing part are preferably arranged so as to adjoin the lid part. This renders it possible to create a sufficient partial space, for example suitable also for larger load impedances, without an enlargement of the dimensions of particularly the bottom portion of the tub-shaped housing part. This partial space may preferably extend between at least that sub-portion of the bottom portion which it adjoins and the outermost component of the components of the stacked arrangement, as seen in a direction away from the bottom portion. The partial space may then extend into regions of the inner space of the housing part which are present between of individual disc-shaped components, seen in a direction parallel to the surface of the bottom portion. The partial space, however, may alternatively extend substantially in the planar surface direction of the bottom portion and in that case may extend into spatial regions of the inner space which extend between the bottom portion and the outermost component.

A partial space also suitable for accommodating larger load impedance arrangements is thus created inside the housing part of the microwave component as a result of the invention. The position of this partial space immediately adjoining the bottom portion thus offers the advantage that load impedance arrangements positioned here can be provided in a good thermal contact with the housing part. This renders it possible to provide load impedances with a comparatively high power dissipation even in very small housing parts without thermal problems, i.e. without overheating of the microwave component during operation. The bottom portion then offers the best conditions for a fast and even removal of generated thermal energy both by its construction and by its thermal contact with the surroundings.

In the microwave component according to the invention, the stacked arrangement of the substantially disc-shaped components preferably comprises in its stacking sequence, starting from the lid part, at least the following:

a microwave guiding arrangement for conducting electromagnetic waves, at least one electrically conducting and/or magnetically permeable intermediate element which extends at least substantially parallel to the bottom portion between the wall portions, and a magnet element.

The partial space then extends at least substantially in a spatial region which adjoins at least partly the bottom portion, the intermediate element, and at least part of the wall portions. The intermediate element may serve as a screen and as an external conductor for microwaves to be supplied to the microwave guiding arrangement, preferably in conjunction with the lid part, provided the intermediate element is electrically conducting. If the intermediate element is magnetically permeable, it preferably also performs the function of a pole disc, which would usually be separately present, for homogenizing the magnetic field provided by the magnet element to the microwave guiding arrangement. It is to be heeded in the latter case, however, that a magnetic short-circuit between the intermediate element and the wall portions should be avoided. For this purpose, for example, air gaps of sufficient dimensions may be provided between the wall portions and the intermediate element. If the intermediate element is made electrically conducting, it is connected to the housing part with electrical conduction. This electrically conducting connection may be provided by direct contact between the intermediate element and the wall portions. This electrical contact, however, must have a low magnetic permeance value.

In another embodiment, the microwave component according to the invention comprises at least one support element which extends along at least one of the wall portions between the bottom portion and the intermediate element with matching shape and/or positive retention for defining the spatial position of the intermediate element in relation to the bottom portion. This support element thus serves to retain and align the intermediate element in the housing part. Preferably, further substantially disc-shaped components may be fastened to the intermediate element, for example by gluing. The positions thereof in the housing part are then also exactly defined by the positioning of the intermediate element.

In a further embodiment of the invention, the support element constitutes an electrically conducting, magnetically non-permeable connection between the bottom portion and the intermediate element. A direct electrical connection to the wall portion(s) may also be achieved, subject to the chosen position of the support element in relation to the wall portion(s). Preferably, the support element is for this purpose made from an electrically conducting material, for example aluminum, which is magnetically non-permeable.

BRIEF DESCRIPTION OF THE DRAWING

Embodiments of the invention are shown in the drawing and are explained in more detail below. Corresponding components have been given the same reference numerals throughout the drawings, in which.

DESCRIPTION OF THE PREFERRED EMBODIMENTS

Figure 1:
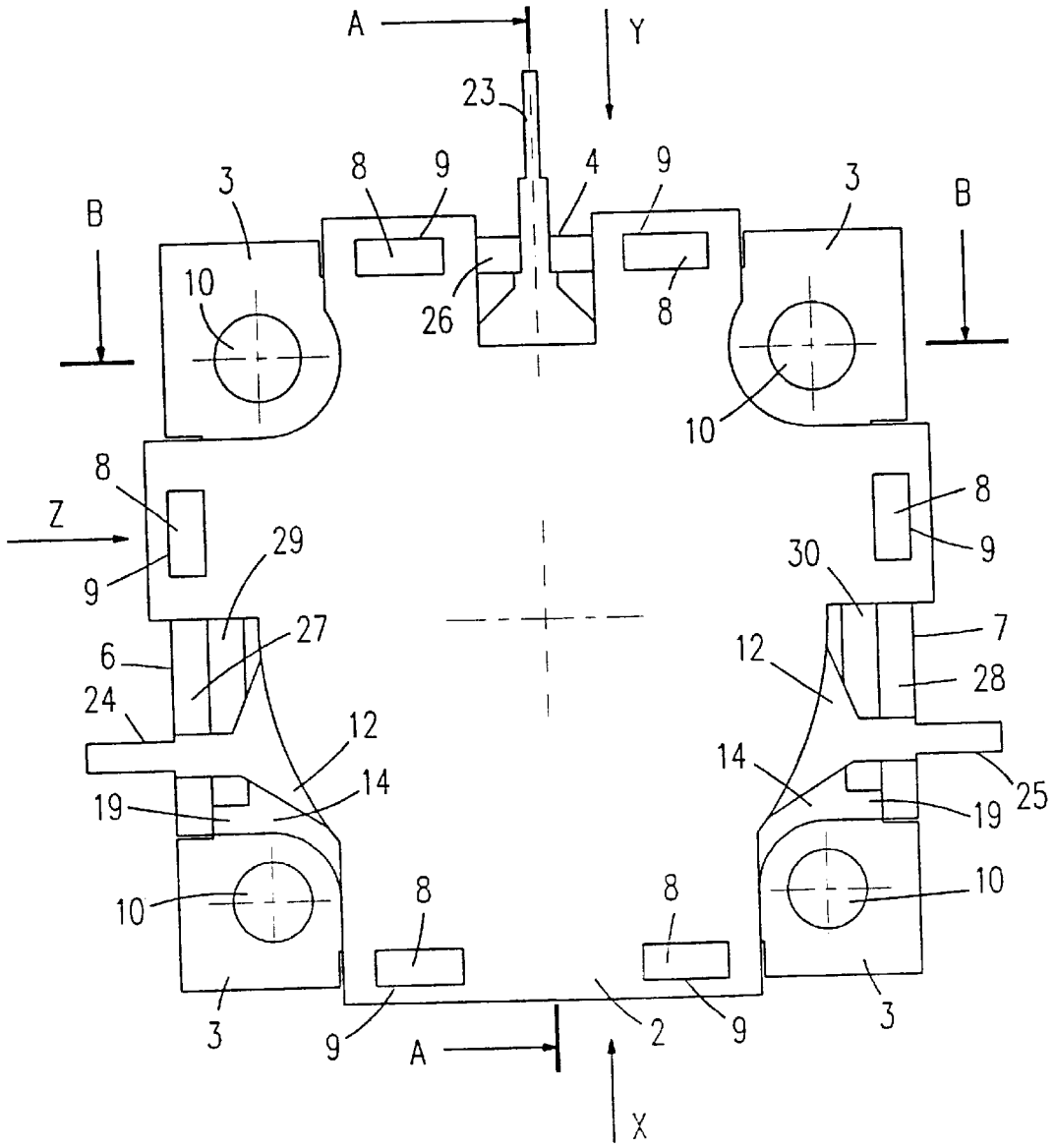
FIG. 1 is a plan view of a microwave component in a first as well as in a second embodiment, referred to as view W hereinafter.
Figure 2:
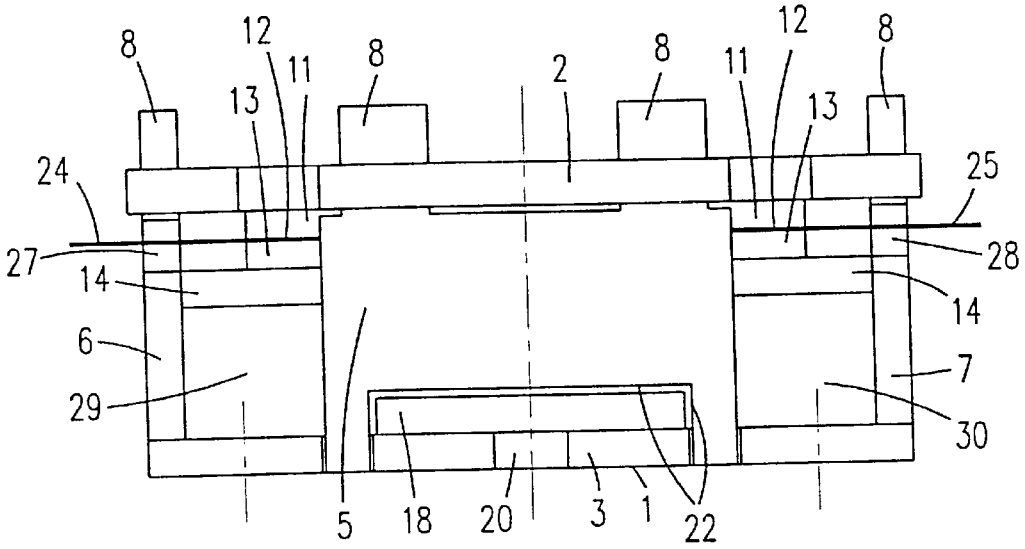
FIG. 2 is a rear elevation of the microwave component of FIG. 1, referred to as view X hereinafter.
Figure 3:
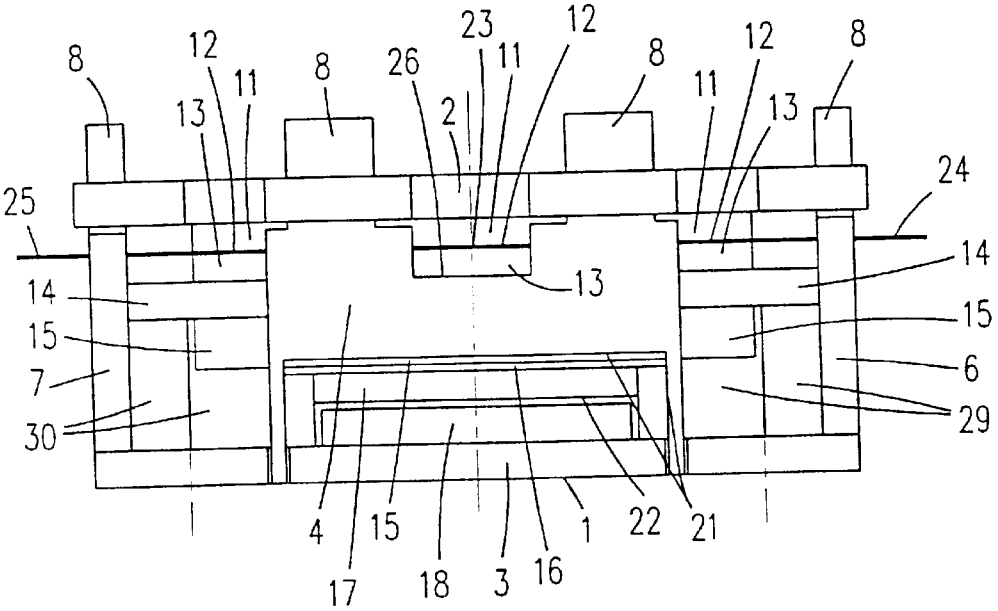
FIG. 3 is a front elevation of the first embodiment of the microwave component of FIG. 1, referred to as view Y hereinafter.

The two embodiments shown in the Figures represent a microwave component which forms a microwave circulator which may be designed to fulfil the function of a microwave isolator through a reflection-free closure of one of its three gates of its microwave guiding arrangement by means of a suitably dimensioned load impedance. This microwave component comprises a housing consisting of a substantially tub-shaped housing part 1 and a lid part 2. The substantially tub-shaped housing part 1 comprises a bottom portion 3 of at least substantially square circumference and four wall portions 4, 5, 6, 7 which follow the circumference of the bottom portion 3. A first wall portion 4 forms the wall of the housing part 1 which is visible in front elevation (view Y). A second wall portion 5 forms the part of the housing portion 1 which is visible in rear elevation (view X), a third wall portion 6 forms the portion of the housing part 1 which is visible in the left-hand side elevation (view Z), and the fourth wall portion 7 forms the portion of the housing part 1 which is visible in a side elevation from the right, opposed to the view Z. The housing part 1 with the bottom portion 3 and wall portions 4 to 7 is preferably made as an integral whole from a substantially planar, magnetically permeable material by a process without metal removal, for example is stamped and folded from a magnetically permeable metal plate. The lid part 2 is manufactured in a similar manner.

The wall portions 4 to 7 are shaped substantially rectangularly. At their edges facing away from the bottom portion, they have stud-type projections 8 which will enter corresponding, mating cavities 9 in the lid part 2 when the housing part 1 and the lid part 2 are joined together. The housing part 1 and the lid part 2 may be joined to one another by gluing, welding, soldering, or flanging or bending of the stud-type projections 8. Any other connection method of the housing part 1 to the lid part 2 which leads to a similar result is also possible.

The wall portions 4 to 7 do not extend to the corners of the substantially square circumference of the bottom portion, but have voids in the regions of these corners. In these corners, bores 10 are provided in the bottom portion 3 which serve as screw holes for fastening the microwave component in an appliance or the like in which the microwave component is utilized. These bores, have circular circumferences; alternatively, they may be formed as slots.

The housing 1, 2 forms part of a magnetic circuit which includes a number of flat substantially disc-shaped components arranged in a stack between the bottom portion 3 and the lid part 2. In order of stacking, these are, starting with the component adjoining the lid part 2: a first ferrite disc 11, a planar inner conductor 12, a second ferrite disc 13, an intermediate element 14, a circular permanent magnet 15, a thermoflux disc 16, and a strip 18 mounted with sliding possibility, separated by an air gap 17 in the arrangement shown. In this stack, the ferrite discs 11, 13 together with the inner conductor 12 form the microwave guiding arrangement, for which the lid part 2 and the intermediate element 14 form the symmetrically spaced outer conductors in this example. The intermediate element 14 is made electrically conducting for this purpose. The intermediate element 14 is furthermore formed from a magnetically permeable material and thus at the same time forms a pole disc for distributing and homogenizing the magnetic field which is generated by the permanent magnet 15 and which permeates the microwave guiding arrangement 11, 12, 13 perpendicularly to the planar dimension of the inner conductor 12. The intermediate element 14 is inserted with matching shape between the wall portions 4 to 7. To avoid a magnetic short-circuit with these wall portions 4 to 7, however, the intermediate element 14 is provided with recessed portions along its sides adjoining the wall portions 4 to 7, so that the intermediate element 14 bears on the wall portions with narrow bridges 19 only. Furthermore, the intermediate element 14 is preferably also manufactured from a magnetically permeable metal plate by a method without metal removal.

Instead of the intermediate element 14 described, a multiple intermediate element may be used, comprising an electrically conducting, foil-type part as the outer conductor for the microwave guiding arrangement 11, 12, 13 and an arrangement of magnetically permeable pole discs in a modification of the embodiment shown.

The strip 18 in the embodiment shown comprises a flat, magnetically permeable metal plate and lies flat against the bottom portion 3. The strip 18 together with the air gap 17 forms a magnetic tuning element which is geometrically changeable and which is present in the magnetic circuit. Shifting of the strip 18 in a direction parallel to the line A—A over the bottom portion 3 changes the contour, in particular the width, of the air gap 17, and thus changes the magnetic permeance thereof. This changes the magnetic field strength in the entire magnetic circuit, and thus also in the region of the microwave guiding arrangement. A simple and accurate tuning of the microwave component is rendered possible in this manner.

In the region of the bottom portion 3 where the strip 18 is arranged with sliding possibility, an elongate opening 20 is provided in the bottom portion 3, for example a stamped-out portion, which can be partly covered by the strip 18 and which extends substantially in the sliding direction of the strip 18. The tuning properties of the magnetic tuning element 17, 18 can be influenced by the choice of contour of this opening 20.

Openings 21 and 22, through which a displacement of the strip 18, and thus a tuning operation can still be easily carried out also, for example, when the microwave component is mounted in an appliance, are provided in the first and the second wall portion 4, 5, respectively, along the edges where these respective wall portions 4, 5 lie against the circumference of the bottom portion 3. A separate mechanical fastening of the strip 18 to the bottom portion 3 is not shown and may indeed be absent, because the two elements are retained in their mutual positions by magnetic attraction. In addition, however, this position of the strip 18 may also be ensured by means of a glue, a locking paint, or the like.

The inner conductor 12 has three connection conductors 23, 24, 25 for forming the three gates of the microwave component. These are passed to the exterior from the housing 1, 2 of the microwave component through suitably arranged recesses 26, 27, 28 in the first, third, and fourth wall portions 4, 6, 7, respectively, such that an electrical insulation of the inner conductor 12 with respect to the housing 1, 2 is safeguarded.

Figure 4:
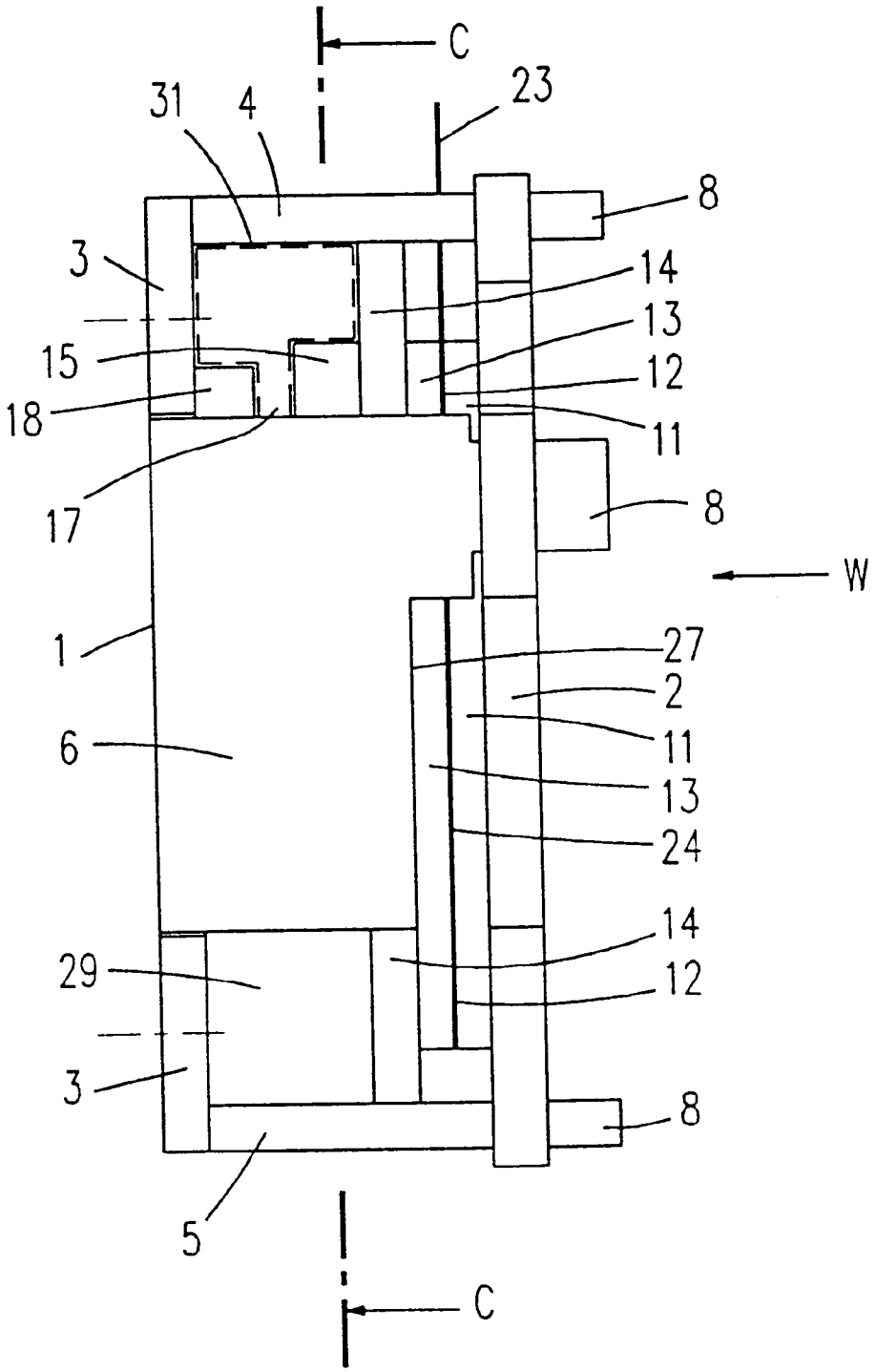
FIG. 4 is a side elevation of the first embodiment of the microwave component shown in FIG. 1, referred to as view Z hereinafter.

The fixation of the assembly position of the flat components 11 to 18, wherein the air gap 17 results from the previously chosen assembly positions of the elements 11 to 16 and 18, is provided by two support elements 29, 30 which extend along the third and fourth wall portions 6 and 7, respectively, with matching shapes (and indeed with positive retention) between the bottom portion 3 and the intermediate element 14. These support elements 29, 30 are electrically conducting, but magnetically non-permeable, and are preferably made from aluminum. They define the spatial position of the intermediate element 14 with respect to the bottom portion 3, i.e. they define the interspacing of these two elements. In addition, they represent the essential electrical connection between the housing part 1 and the intermediate element 14. The support elements 29, 30 here fill up part of the spatial region inside the microwave component which is bounded by the bottom portion 3, the intermediate element 14, and the wall portions 4 to 7. This spatial region further contains the permanent magnet 15 and the thermoflux disc 16, as well as the magnetic tuning element with the strip 18 and the air gap 17 which can be influenced thereby. A partial space 31 adjoining a sub-portion of the bottom portion 3 is left open by the components listed above inside the spatial region described. This partial space 31 is indicated with a bold broken line in FIG. 4. In this partial space 31, which is contiguous with the bottom portion 3 and thus has a good electrical and especially thermal contact with the bottom portion 3, it is preferable to position the load impedance mentioned above by means of which one of the connection conductors of the inner conductor 12, preferably the first connection conductor 23, can be connected free from reflection. The partial space 31 present here renders possible a load impedance arrangement which can be designed for high power losses in relation to the dimensions of the housing 1, 2 of the microwave component. A microwave isolator of a high power class and having very compact dimensions can thus be constructed. A load impedance with a power dissipation in the range of between 50 and 200 W is envisaged in particular. This large load impedance can be accommodated inside the housing 1, 2 without an increase in the dimensions of the bottom portion 3. The arrangement of the load impedance adjacent the bottom portion 3 further safeguards a thermal uncoupling from the microwave guiding arrangement 11 to 13.

The strip 18 is first inserted into the housing part 1 during assembly. Then the support elements 29, 30 are inserted into the housing part 1. The thermoflux disc 16 and the permanent magnet 15 are then positioned in the spatial region lying between the support elements 29, 30 and the bottom portion 3 or the strip 18, and this spatial region is covered with the intermediate element 14. To ensure the air gap 17 being present, the height of the support elements 29, 30 in the viewing direction of view W must be greater than the sum of the heights of the strip 18, the thermoflux disc 16, and the permanent magnet 15. Instead of the single thermoflux disc 16 shown for reasons of simplicity, an arrangement of several thermoflux discs may be used in practice. It is advantageous to fasten the permanent magnet 15 and the thermoflux disc 16 on the intermediate element 14 in a pre-assembly step, for example by gluing, and to place the sub-assembly 14, 15, 16 thus prepared with the permanent magnet 15 forward onto the support elements 29, 30, i.e. in the direction of the bottom portion 3. The microwave guiding arrangement with the ferrite discs 11, 13 and the inner conductor 12 is placed layer by layer on the intermediate element 14, and is fastened by fixing the lid part 2 to the housing part 1.

The assembly of the entire microwave component can be carried out stackwise in a mounting jig which, for example, comprises three pins which are threaded through corresponding holes in the bottom portion 3, which are not shown in the embodiments, for assembly purposes and which define the positions of the individual, disc-shaped components 11 to 16 and 18. After the lid part 2 has been fastened, the microwave element is taken off the pins.

The permanent magnet 15 is incorporated in the fully magnetized state. The magnetic field necessary for the operation of the microwave component is tuned by means of the movable strip. The opening 20 in the bottom portion 3 may be used for mechanical access to this strip 18 as long as this opening is accessible, in dependence on the assembly position of the microwave component.

Figure 5:
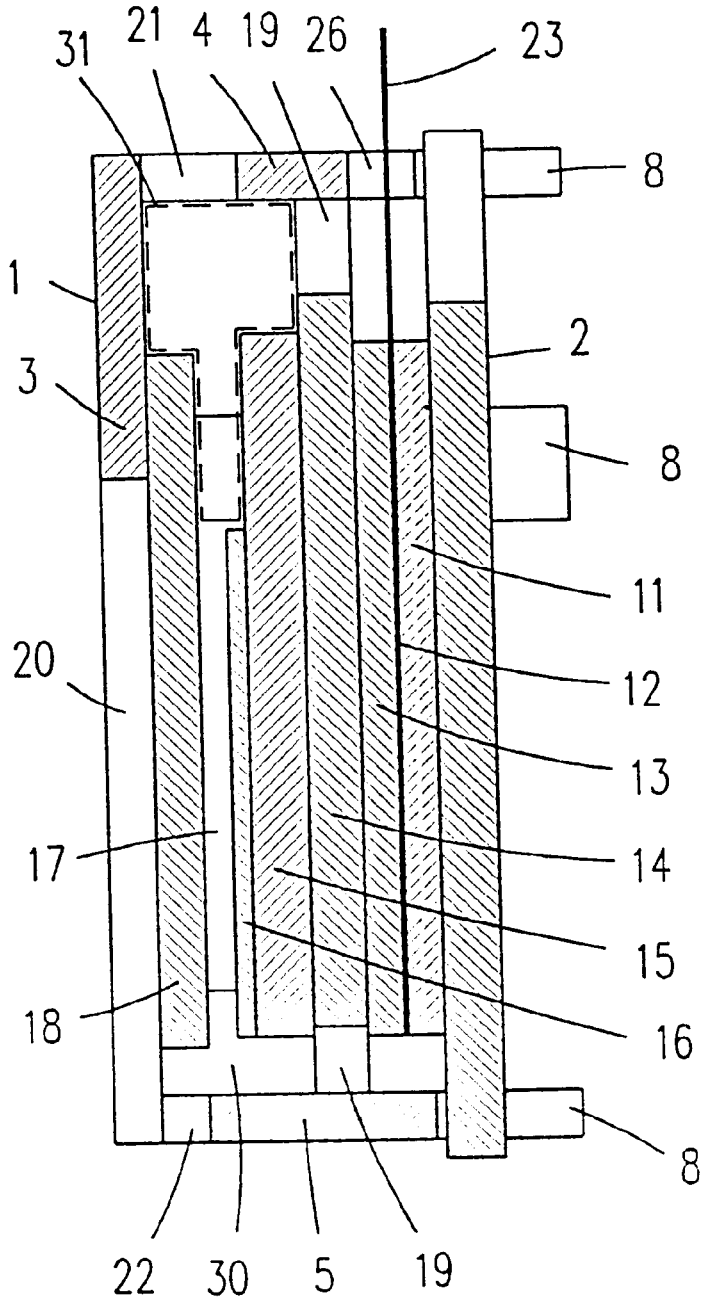
FIG. 5 is a cross-section through the first embodiment of the microwave component of FIG. 1 taken on the line A—A in FIG. 1.
Figure 8:
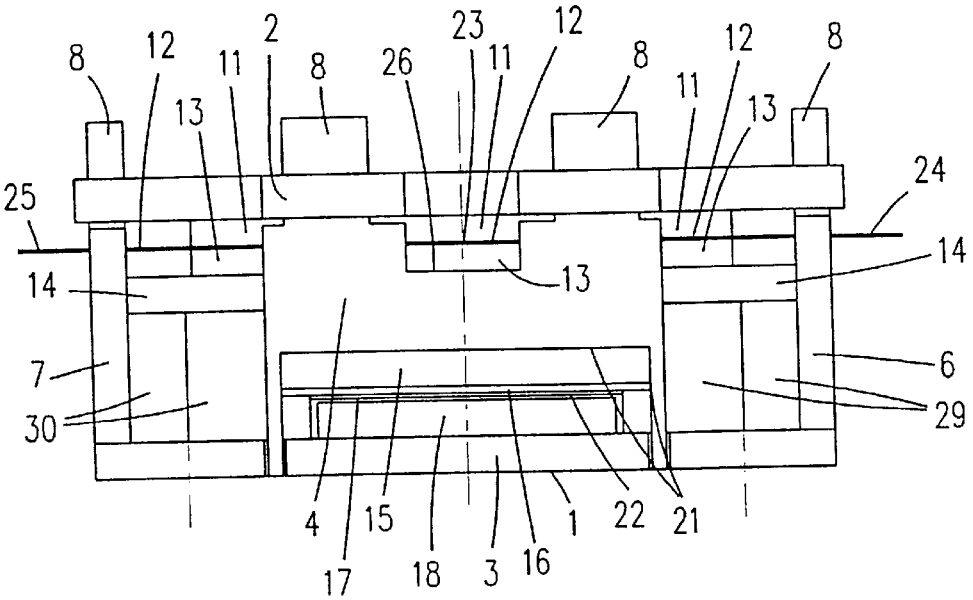
FIG. 8 is a front elevation (view Y) of a second embodiment of the microwave component of FIG. 1.
Figure 6:
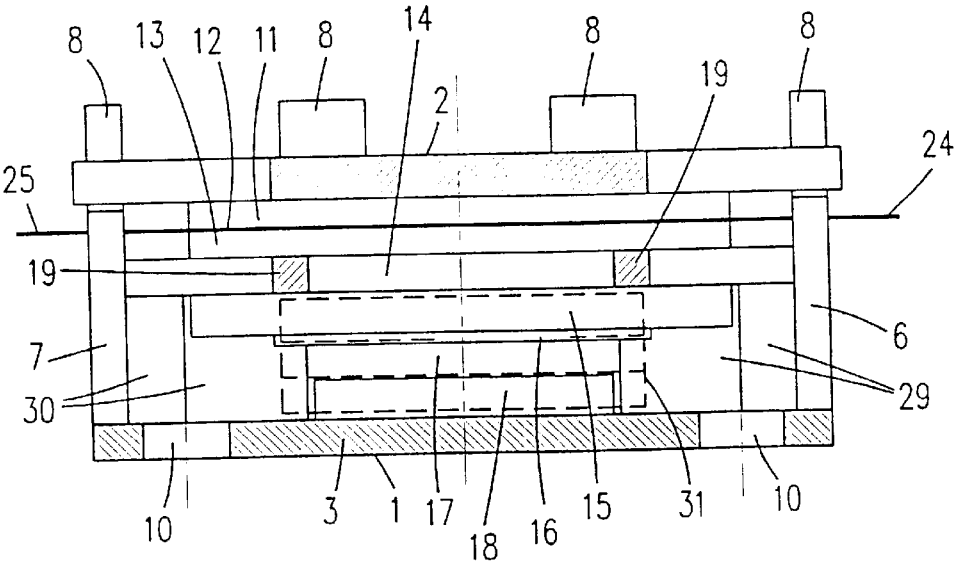
FIG. 6 is a cross-section through the first embodiment of the microwave component of FIG. 1 taken on the line B—B in FIG. 1.
Figure 7:
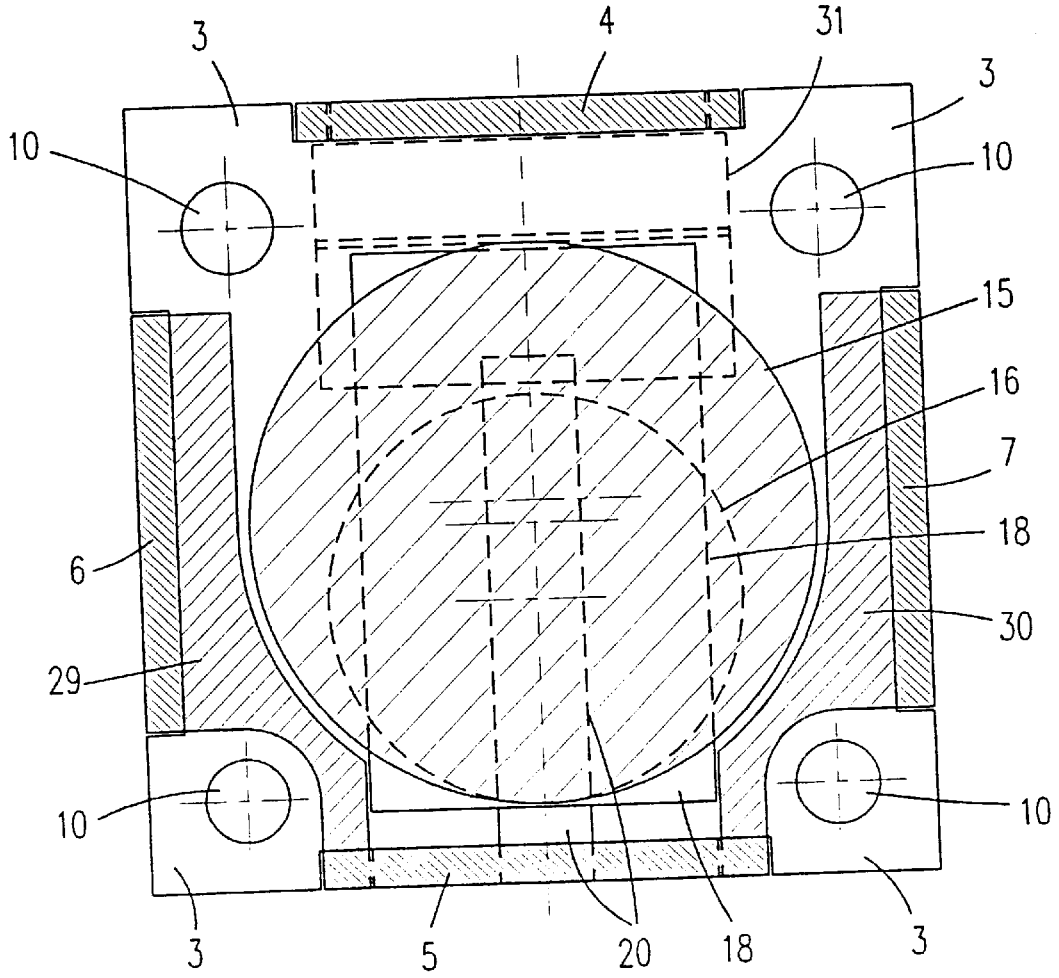
FIG. 7 is a cross-section through the first embodiment of the microwave component of FIG. 1 taken on the line C—C in FIG. 4.
Figure 9:
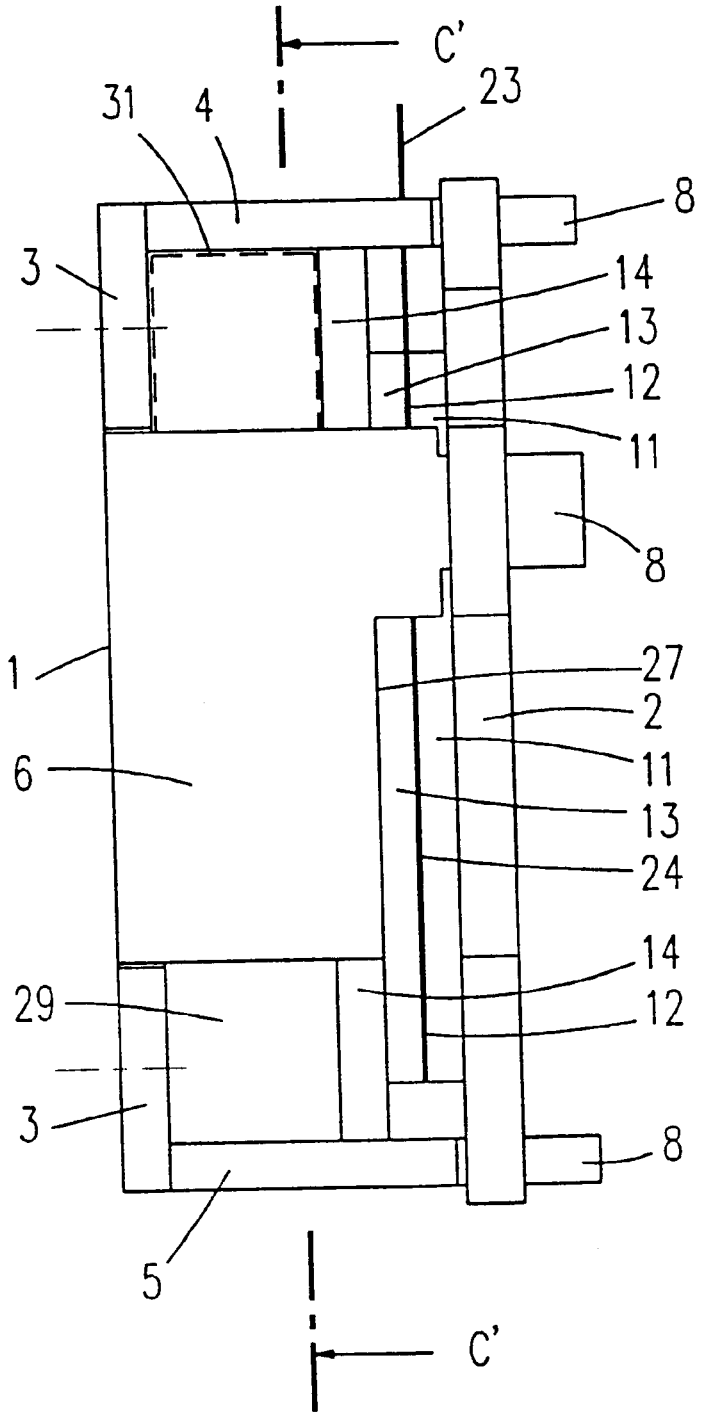
FIG. 9 is a side elevation (view Z) of the second embodiment of the microwave component of FIG. 1.
Figure 10:
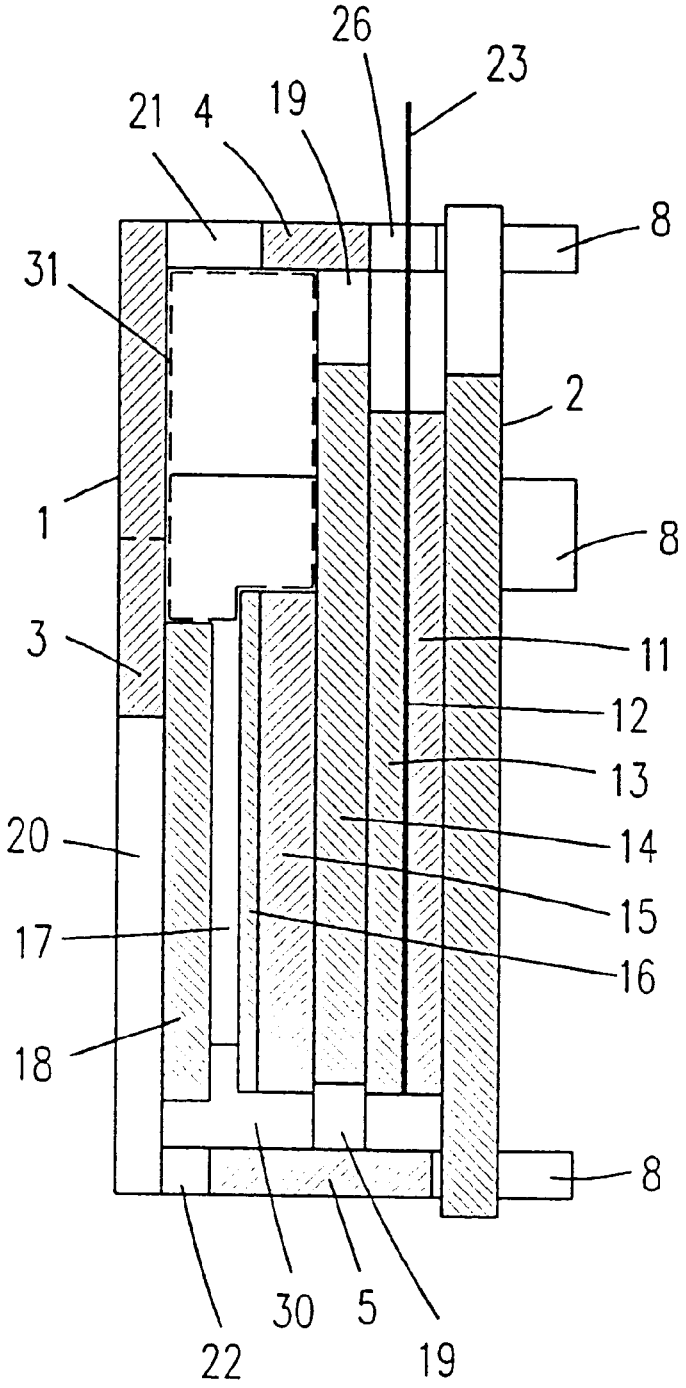
FIG. 10 is a cross-section through the second embodiment of the microwave component of FIG. 1 taken on the line A—A in FIG. 1.
Figure 11:
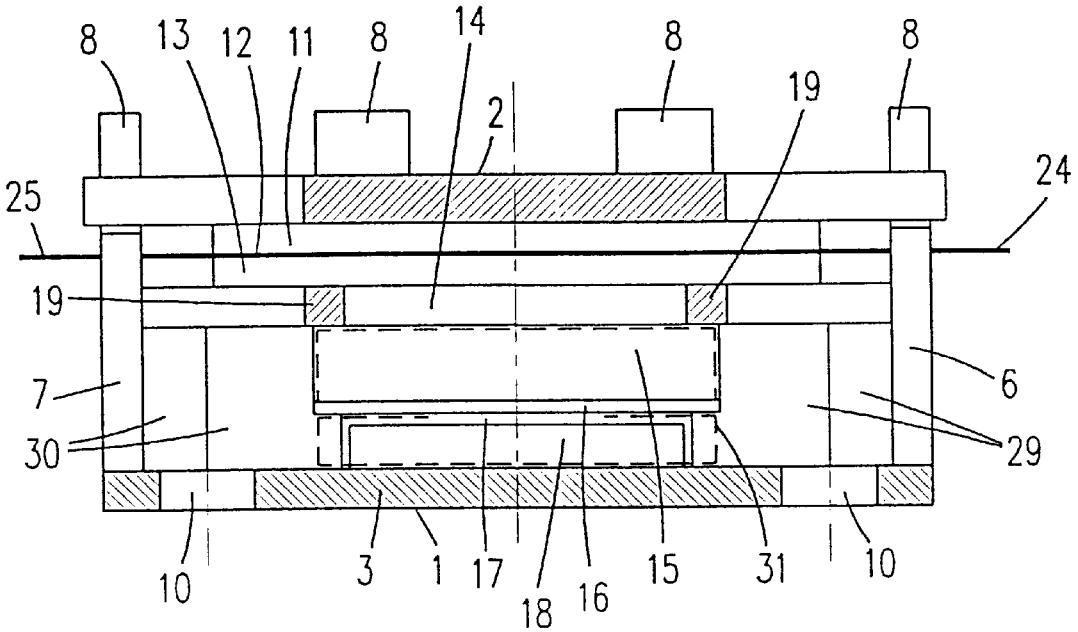
FIG. 11 is a cross-section through the second embodiment of the microwave component of FIG. 1 taken on the line B—B in FIG. 1.
Figure 12:
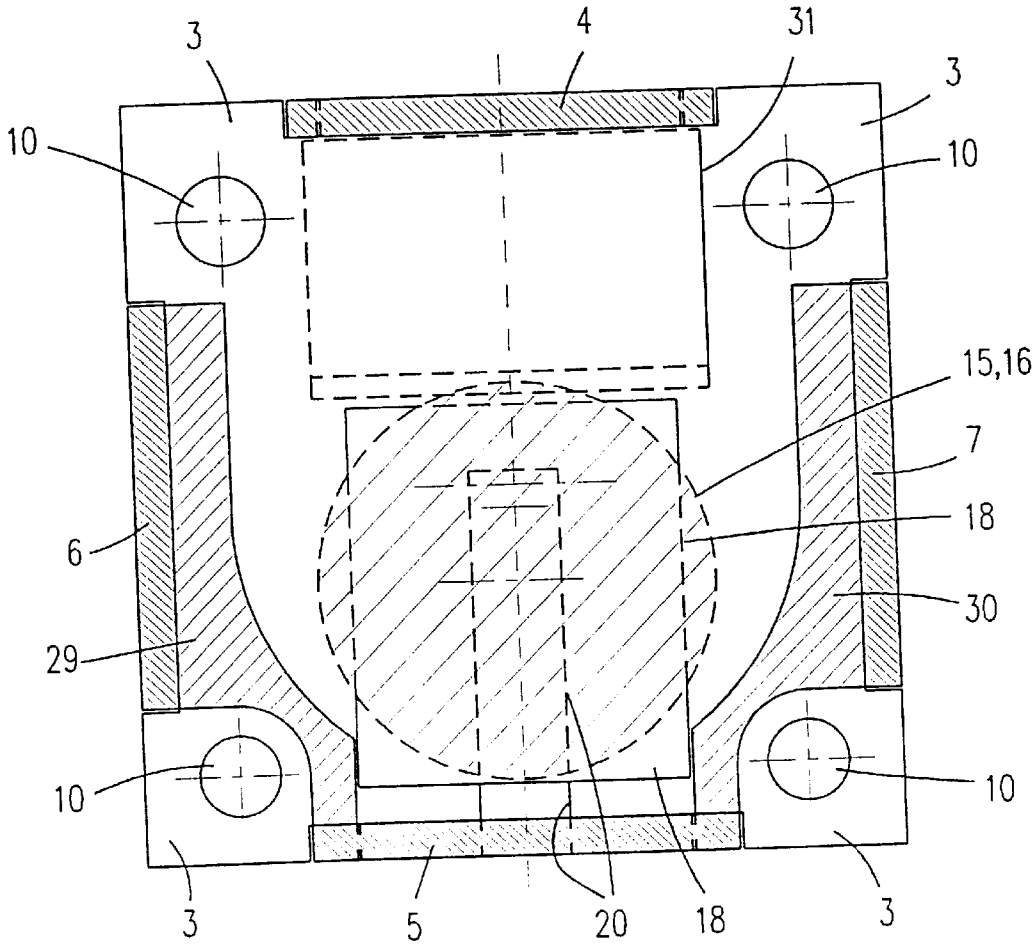
FIG. 12 is a cross-section through the second embodiment of the microwave component of FIG. 1 taken on the line C'—C' in FIG. 9.

The embodiments shown in the Figures differ from one another as regards the shape of the partial space 31 as a result of the shape chosen for the permanent magnet 15 each time. Whereas in the first embodiment of FIGS. 1 to 7 the disc-shaped permanent magnet 15 has a radial dimension which corresponds substantially to that of the ferrite discs 11, 13, the second embodiment of FIGS. 1, 2, and 8 to 12 shows a permanent magnet of smaller radial dimensions. To achieve a comparable volume for the permanent magnet 15, the thickness of the disc-shaped permanent magnet 15 in the second embodiment is chosen to be greater than in the first embodiment. Similarly, the partial space 31 in the first embodiment extends for a major portion thereof into the air gap 17 between the permanent magnet 15 and the strip 18, FIG. 5. By contrast, the partial space 31 in the second embodiment lies to a much greater extent in a spatial region between the bottom portion 3 and the intermediate element 14 outside of air gap, bounded laterally by the first wall portion 4 at one side and by the permanent magnet 15 and the strip 18 at the other side (FIG. 10). The smaller radial dimension of the permanent magnet 15 in the second embodiment renders possible an increase in the partial space 31 for the accommodation of a load impedance, as compared with the first embodiment.

What is claimed is:

1. A microwave component comprising a tub-shaped magnetically permeable housing part comprising a bottom portion having a circumference and wall portions extending upward from said circumference, a magnetically permeable lid part fitted on at least one of said wall portions so that said housing part and said lid part enclose an inner space, a plurality of flat components arranged in a stack in said inner space, said components comprising, in a sequence starting from the lid part, a microwave guiding arrangement, an intermediate element extending parallel to said bottom portion between the wall portions, and a magnet element, and at least one support element extending along a respective at least one of said wall portions between the bottom portion and the intermediate element, thereby defining the position of the intermediate element relative to the bottom portion, and a partial space of the inner space left open by the stack, said partial space being contiguous with the bottom portion, the intermediate element, and at least one of the wall portions.

2. A microwave component as in claim 1 wherein said intermediate element is electrically conducting.

3. A microwave component as in claim 2 wherein said intermediate element is magnetically permeable.

4. A microwave component as in claim 1 wherein said intermediate element is magnetically permeable.

5. A microwave component as in claim 1 wherein said intermediate element has a shape which is complementary to said support element.

6. A microwave component as in claim 5 wherein said intermediate element is positively retained.

7. A microwave component as in claim 1 wherein said intermediate element is positively retained.

8. A microwave component as in claim 1 wherein said wall portions are integral with said bottom portion.

* * * * *